US005458323A

United States Patent [19]

Magee et al.

[11] Patent Number: 5,458,323

[45] Date of Patent: Oct. 17, 1995

[54] BINDING LINE WITH MISFEED SCANNER LOCATED ON GATHERING LINE

[75] Inventors: Lawrence D. Magee, Bolingbrook; Ronald W. Hastie, Elk Grove Village, both of Ill.

[73] Assignee: R. R. Donnelley & Sons Copmany, Lisle, Ill.

[21] Appl. No.: 275,533

[22] Filed: Jul. 15, 1994

[51] Int. Cl.[6] ..... B65H 39/04

[52] U.S. Cl. ..... 270/54

[58] Field of Search ..... 270/54, 53, 55

[56] References Cited

U.S. PATENT DOCUMENTS

| | | | |
|---|---|---|---|
| 1,142,417 | 6/1915 | Gitzendanner . | |
| 4,121,818 | 10/1978 | Riley et al. . | |
| 4,204,639 | 5/1980 | Barber et al. . | |
| 4,395,031 | 7/1983 | Gruber et al. | 270/54 |
| 4,580,770 | 4/1986 | Warden et al. | 270/58 |
| 4,799,661 | 1/1989 | Nail | 270/54 |
| 4,923,189 | 5/1990 | Nail | 270/54 |
| 5,039,077 | 8/1991 | Gunther, Jr. | 270/58 X |
| 5,067,088 | 11/1991 | Schneiderhan | 270/58 X |
| 5,114,128 | 5/1992 | Harris, Jr. et al. | 270/54 |
| 5,143,362 | 9/1992 | Doane et al. | 270/54 X |
| 5,161,790 | 11/1992 | March . | |
| 5,280,895 | 1/1994 | Meier | 270/54 X |

FOREIGN PATENT DOCUMENTS

| | | | |
|---|---|---|---|
| 1218401 | 6/1966 | Germany | 270/54 |
| 135052 | 10/1980 | Japan | 270/54 |

*Primary Examiner*—John E. Ryznic

*Attorney, Agent, or Firm*—Marshall, O'Toole, Gerstein, Murray & Borun

[57] ABSTRACT

In order to verify that a packer box on a binding line has successfully dropped the correct signature onto a gathering chain, a unique system and method are disclosed wherein the system includes utilizing common indicia in a preselected location on each of the signatures to be fed from the packer box and a scanner is provided along the gathering chain generally adjacent the packer box holding the signatures. The scanner is positioned relative to the gathering chain to scan for the common indicia in the region where the preselected location passes when one of the signatures has been fed to the gathering chain to occupy one of the chain spaces thereof, and the information gathered by the scanner is utilized to verify whether a correct one of the signatures occupies the chain space by utilizing the information which is gathered by the scanner. In accordance with the method, the common indicia is provided on the signatures, a scanner is provided along the gathering chain, and the method further includes scanning for the common indicia on the signatures and monitoring the scanner for recognition of the common indicia in order to verify whether a correct one of the signatures was successfully fed from a packer box onto the correct chain space of the gathering chain.

30 Claims, 2 Drawing Sheets

BINDING LINE WITH MISFEED SCANNER LOCATED ON GATHERING LINE

FIELD OF THE INVENTION

The present invention generally is related to binding line operation and, more particularly, a unique packer box signature verification system and method.

BACKGROUND OF THE INVENTION

Many large circulation periodicals are gathered on a binding line for stitching, trimming, bundling, and shipping. The binding line typically may include a plurality of signature feeding apparatus, commonly called packer boxes, each of which may have a driven rotary drum with a plurality of signature grippers disposed about the periphery thereof, and the signature grippers may be adapted to grip signatures seriatim as they are received from a signature supply means after they have been shifted therefrom to the rotary drum by cam driven suction means or other like components. Conventionally, the suction means will include oscillating suction grippers together with a vacuum control valve operatively associated therewith.

In the case of saddle stitched books, a packer box will open the pages of a signature so that it may be dropped onto a saddle conveyor or gathering chain. The gathering chain then conveys that signature on a particular chain space to the next packer box which may, in like manner, drop still another signature in straddle relation on top of the previously so distributed signature or signatures. In this manner, a book comprised of an entire collection of different signatures can be gathered on the saddle conveyor or gathering chain for stitching.

As will be appreciated by those skilled in the art, a book is simply a collection of signatures, each of which may have a backbone, a head, a foot, and a pair of folios, regardless of the number of signatures and regardless of the manner in which the book is bound.

In more recent years, the books that are gathered on a binding line have been customized and/or personalized by utilizing a variety of different techniques. Typically, this has involved computer control systems whereby different combinations of packer boxes along a binding line are selectively disabled and enabled in order to thereby customize books in accordance with demographics or the like. As a result, there has been a need to be able to monitor operation of the various packer boxes on a binding line in a manner that is entirely satisfactory.

Even when the books that are gathered on a binding line are not customized and/or personalized, monitoring of the packer boxes is important. It is sometimes the case that a packer box will malfunction and, thus, not successfully feed a signature onto a chain space of a gathering chain, and, in addition, it sometimes happens that the wrong signatures will be supplied to a particular packer box. If either of these occur, a correct signature that is needed for a given book will not be delivered to the gathering chain as required.

As a result, the book that was being formed will be defective and must be discarded and reordered. It is, of course, possible by means of calipers to determine when a signature has failed to be delivered, but, if the wrong signatures have been improperly loaded into a given packer box, detection is rendered far more difficult, meaning that it is highly likely that significant waste will occur because of the time interval before detection is likely to be noted. As a result, it has remained to eliminate this known problem area in the operation of binding lines.

The present invention is directed to overcoming one or more of the foregoing problems and achieving one or more of the resulting objectives.

SUMMARY OF THE INVENTION

It is a principal object of the present invention to improve efficiency and eliminate waste in binding line operation. It is a further object of the present invention to provide a unique packer box signature verification system and method. It is an additional object of the present invention to verify whether a correct signature has been fed by scanning for common indicia thereon.

Accordingly, the present invention is directed to an improvement in a binding line of the type having a gathering chain which is movable past a plurality of packer boxes. The gathering chain has a plurality of chain spaces, each of which is adapted to gather a signature from each of at least some of the packer boxes in seriatim fashion. The packer boxes each are adapted to hold a different one of a set of signatures to be fed to the gathering chain. The improvement comprises common indicia in a preselected location on each of the signatures to be fed from at least one of the packer boxes, together with scanning means along the gathering chain generally adjacent the packer box holding the signatures having the common indicia. The scanning means is positioned relative to the gathering chain in order to scan for the common indicia. The scanning means is positioned to scan in the region where the preselected location on the signatures passes when one of the signatures has been fed to the gathering chain to occupy one of the chain spaces thereon. With this arrangement, the improvement also includes means associated with the scanning means for verifying if the correct one of the signatures occupies the one of the chain spaces that is monitored.

In one highly preferred embodiment, common indicia is provided in a preselected location on each of the signatures of the set of signatures for identifying the signatures as belonging to the set. It will then be understood that scanning means is provided along the gathering chain generally adjacent each of the packer boxes. Still additionally, a separate flare/divert unit is preferably mounted generally adjacent the gathering chain and adjacent or near each of the packer boxes for separating signatures to scan for the common indicia.

Preferably, the signatures of the set all have a backbone, a head, a foot, and a pair of folios with one of the folios formed so as to be slightly longer than the other of the folios. The preselected location on each of the signatures having the corresponding common indicia is then advantageously inside the longer one of the pair of folios thereof. Additionally, the common indicia preferably is in the form of bar codes adjacent the heads of the signatures and along the edges of the longer ones of the folios remote from the backbones thereof.

In a most highly preferred embodiment, the scanning means comprise laser scanners each supported on an adjustable scanner mounting bracket at a point below the gathering chain and slightly upstream of the corresponding one of the packer boxes. The flare/divert units each preferably include a flare leg supporting the longer ones of the folios of the signatures fed by the corresponding one of the packer boxes. The flare/divert units also each preferably include a divert leg diverting the longer ones of the folios of the signatures fed to the gathering chain by upstream ones of the packer boxes. The flare legs preferably each have upstream and downstream edges and include a cutout adjacent the downstream edge to expose the bar codes to the corresponding one of the laser scanners. With this arrangement, the adjustable scanner mounting brackets each advantageously include a laser scanner support arm which is mounted on a threaded rod for moving the laser scanner toward and away from the gathering chain.

In a most highly preferred embodiment, the adjustable scanner mounting brackets each are secured to the flare leg of the corresponding one of the flare/divert units in proximity to the downstream edge and the cutout. The flare/divert units are also preferably such that the flare legs are each disposed at an acute angle to a vertical plane through the gathering chain to support the longer one of the folios, and the divert legs each have an upstream and downstream edge and include an angled portion at the upstream edge directing signatures fed by the upstream ones of the packer boxes toward the gathering chain. In this connection, the flare/divert units each preferably have a generally inverted V-shape and include a wheel positioned above the gathering chain for holding the signatures down generally over the laser scanner.

In another respect, the present invention is directed to a unique and improved method for verifying that a signature has been fed from a packer box to a gathering chain. The method includes the step of providing common indicia in a preselected location on each of a plurality of signatures to be fed from the packer box to the gathering chain. A scanner is also provided along the gathering chain generally adjacent the packer box to scan for the common indicia on the signatures in the preselected location, and the method includes the step of scanning for the common indicia on the signatures in the region where the preselected location passes when one of the signatures has been fed to the gathering chain. The method further includes the step of monitoring the scanner for recognition of the common indicia in order to verify whether a correct one of the signatures was successfully fed from the packer box to the gathering chain. Most advantageously, the method will further include the step of supporting the longer of a pair of folios of the signatures in a selected position during the scanning step.

More specifically, the preselected location for the common indicia on each of the signatures is preferably inside the longer of a pair of folios thereof. It is also highly advantageous for the common indicia to comprise a bar code and for the scanner to comprise a laser scanner. By supporting the longer of a pair of folios in a selected position during the scanning step, the laser scanner can read the common indicia if it is actually present.

Still additionally, the method includes supporting the longer of the pair of folios of the signatures at an acute angle to a vertical plane through the gathering chain. It also includes diverting the longer of the pairs of folios of signatures fed to the gathering chain by upstream packer boxes. More specifically, the longer of the pairs of folios are diverted to a generally vertical position which is generally parallel to a vertical plane which passes through the gathering chain.

Other objects, advantages and features of the present invention will become apparent from a consideration of the following specification taken in conjunction with the accompanying drawings.

DETAILED DESCRIPTION OF THE PREFERRED EMBODIMENT

Figure 1:
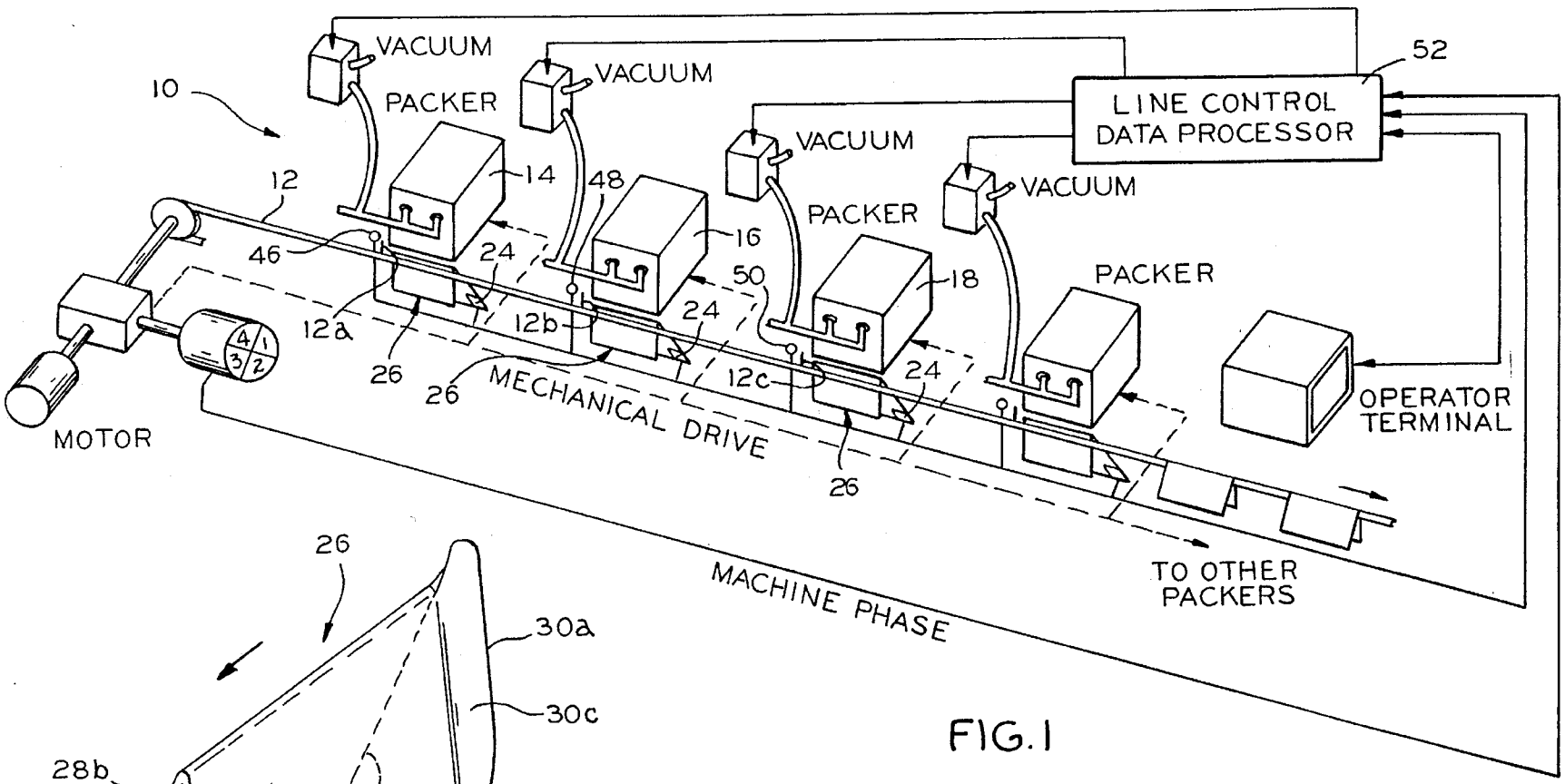
FIG. 1 is a schematic view of a binding line with signature verification in accordance with the present invention.

In the illustrations given, and with reference first to FIG. 1, the reference numeral 10 designates generally a binding line having a gathering chain 12 which is movable past a plurality of packer boxes 14, 16, 18, etc. The gathering chain 12 will be seen to have a plurality of chain spaces 12a, 12b, 12c, etc., each of which is adapted to gather a signature such as 20 (see FIG. 2) from each of at least some of the packer boxes 14, 16, 18, etc., in seriatim fashion where each of the signatures, such as 20, has a backbone 20*a*, a head 20*b*, a foot 20*c*, and a pair of folios 20*d* and 20*e* with one of the folios, such as 20*e*, being longer than the other, such as 20*d*. As will be appreciated by those skilled in the art, the packer boxes 14, 16, 18, etc., are each adapted to hold a different one of a set of the signatures which are to be fed to the gathering chain 12 in conventional fashion.

Figure 2:
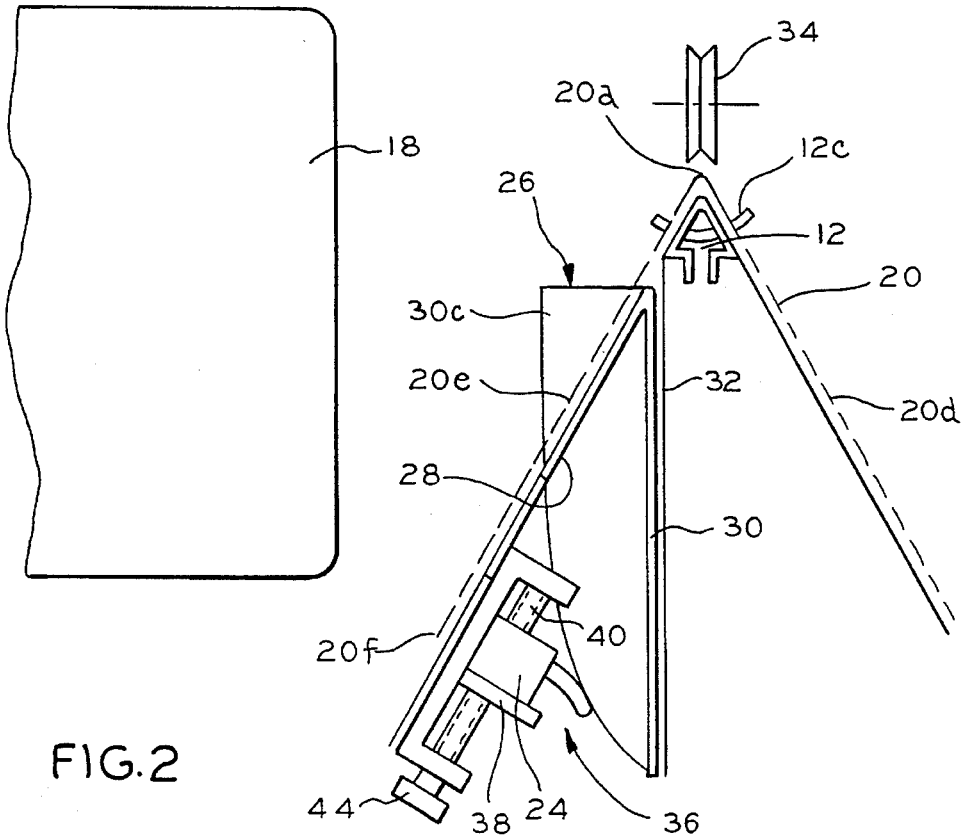
FIG. 2 is a side elevational view, partially broken away, illustrating the signature verification system in more detail.

As best shown in FIG. 2, common indicia, such as a bar code 22, is provided in a preselected location on each of the signatures, such as 20, to be fed from at least one of the packer boxes, such as 18, for identifying the signatures as being the correct one to be fed to the gathering chain 12 from that packer box. It will also be seen that scanning means, such as a laser scanner 24, is provided along the gathering chain 12 generally adjacent at least one and preferably each of the packer boxes 14, 16, 18, etc., holding the different signatures of the set. Still referring to FIG. 2, the laser scanners, such as 24, each are positioned relative to the gathering chain 12 to scan for the bar codes 22 in the region where the preselected locations pass when the signatures, such as 20, have been fed to the gathering chain 12 to occupy one of the chain spaces, such as 12*c*.

Figure 4:
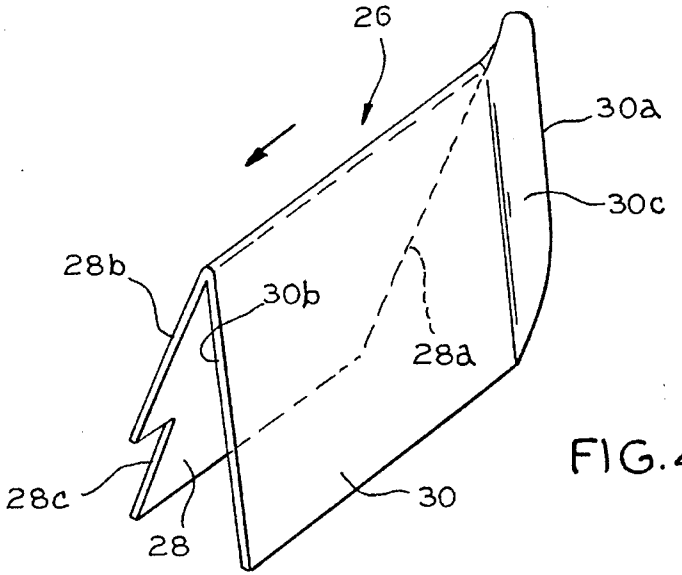
FIG. 4 is a perspective view of a flare/divert unit for the signature verification system according to the present invention.
Figure 3:
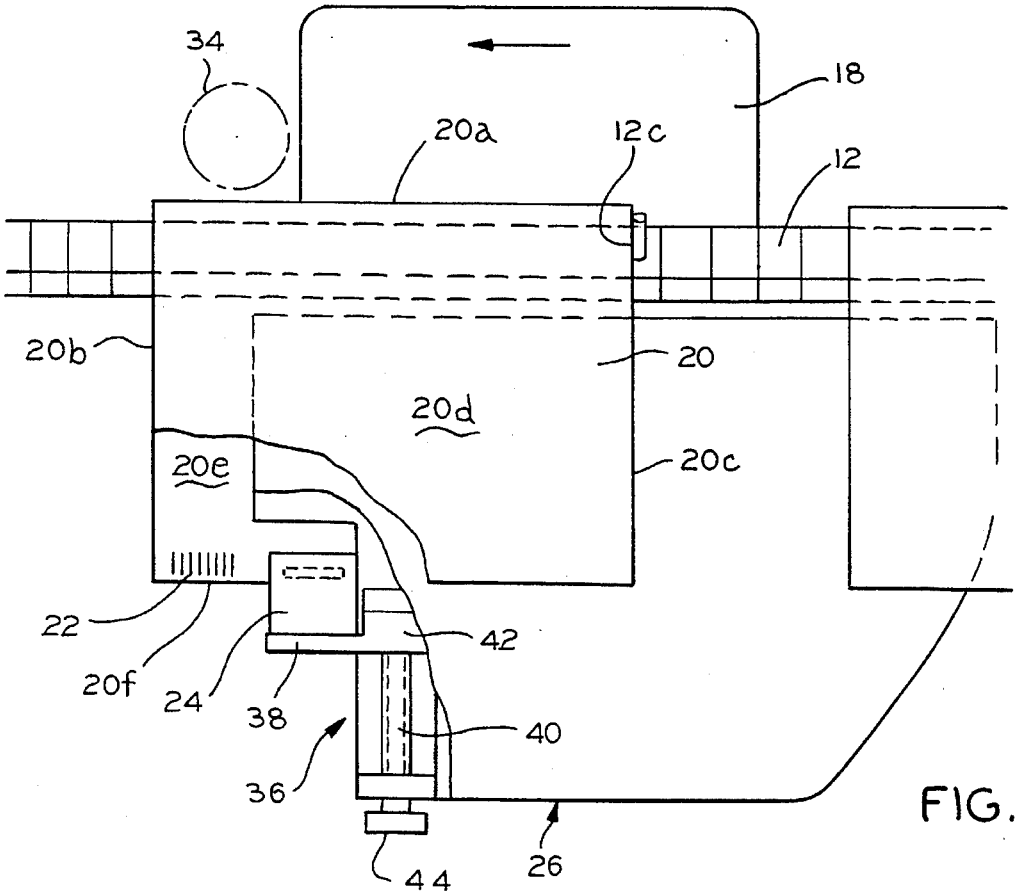
FIG. 3 is a front elevational view of the signature verification system as also illustrated in FIG. 2.

Referring to FIGS. 2–4, a separate flare/divert unit 26 is mounted generally adjacent the gathering chain 12 and at least one and preferably each of the packer boxes 14, 16, 18, etc., for separating signatures in order to scan for the bar codes 22. The flare/divert units 26 each includes a flare leg 28 supporting the longer one of the folios 20*e* of the signatures, such as 20, fed to the gathering chain 12 by the corresponding one of the packer boxes, such as 18. The flare/divert units 26 also each includes a divert leg 30 diverting the longer ones of the folios 32*e* of the signatures 32 fed to the gathering chain 12 by the upstream ones of the packer boxes, such as 14 and 16. Referring specifically to FIGS. 2 and 4, the flare legs 28 each have upstream and downstream edges 28*a* and 28*b* and include a cutout 28*c* adjacent the downstream edge 28*b* to expose the bar codes 22 to the corresponding one of the laser scanners 24.

As best shown in FIG. 3, the flare legs 28 each are preferably disposed at an acute angle to a generally vertical plane which passes through the gathering chain 12 in order to support the longer one of the folios 20*e* at an acute angle thereto. It will also be seen from FIG. 4 that the divert legs 30 each have upstream and downstream edges 30*a* and 30*b* and include an angled entry portion 30*c* at the upstream edge 30*a* which serves to direct one or more signatures 32 fed by the upstream ones of the packer boxes 14 and 16 in a direction generally toward the gathering chain 12. As will be clear from FIGS. 3 and 4, the flare/divert units 26 each have a generally inverted V shape and include a wheel 34 positioned above the gathering chain 12 for holding down the signatures, such as 20 and 32, generally over the laser scanner 24.

Referring specifically to FIG. 2, it will be seen and understood that the preselected location on each of the signatures, such as 20, of each of the different sets of signatures having the bar code 22, is preferably inside the longer one of the folios 20*e*. It is still more specifically in a position generally adjacent the heads 20*b* of the signatures, such as 20, and along the edges 20*f* of the longer ones of the folios 20*e*, i.e., remote from the backbones 20*a* of the signatures such as 20. With this arrangement, the laser scanners 24 are each supported on an adjustable scanner mounting bracket 36 at a point below the gathering chain 12 and slightly upstream of the corresponding one of the packer boxes, such as 18.

By comparing FIGS. 2 and 3, the adjustable scanner mounting brackets 36 will each be seen to include a laser scanner support arm 38 mounted on a threaded rod 40 for moving the laser scanner 24 toward and away from the gathering chain 12. It will be seen that this occurs by reason of the cooperation of the threaded rod 40 with internal threads (not shown) in a rod-receiving sleeve 42 at one end of the laser scanner support arm 38 and, by turning the knob 44 to thereby rotate the threaded rod 40, the laser scanner 24 on the support arm 38 is driven toward and away from the gathering chain 12, depending upon the direction of rotation. As will be apparent from both FIGS. 2 and 3, the adjustable scanner mounting brackets 36 each are secured to the flare leg 28 of the corresponding one of the flare/divert units 26 in proximity to the downstream edge 28*b* and the cutout 28*c*.

In a most general sense, the present invention can be utilized to verify that at least one packer box on a binding line has dropped the correct signature onto the gathering chain at the correct time. It will be appreciated, of course, that it typically will be desirable to verify that each packer box on a binding line has successfully dropped the correct signature onto the gathering chain at the correct time, i.e., it will be advantageous to utilize the present invention to not only tell whether the packer boxes have successfully dropped signatures as appropriate but also to verify that the correct one of a plurality of signatures making up a book has been dropped at the proper location. By utilizing the present invention, this objective has been achieved in a manner making it possible to replace the caliper that is conventionally used to detect a defective book.

With the system of the present invention, the packer boxes 14, 16, 18, etc., each have a flare/divert unit 26 mounted below the gathering chain 12 (see FIGS. 2 and 3). It will also be appreciated that each of the flare/divert units 26 has an adjustable laser scanner 24 mounted to it on a bracket 36. As a signature, such as 20, drops onto the gathering chain 12, the longer of the folios 20*e* of that particular signature is suitably flared open by the flare leg 28 substantially as shown in the drawings.

As previously mentioned, the signatures, such as 20, have the bar code 22 printed on the inside leading edge of the longer of the folios 20*e*. As the signature, such as 20, passes by the cutout 28*c*, the bar code 22 is read by the laser scanner 24. To make this possible to achieve, the previously dropped signatures 32 are diverted by the angled leading edge entry portion 30*c* of the divert leg 30.

As will be appreciated, this prevents the previously dropped signatures 32 from blocking the bar code 22 on the "just down" signature, such as 20, so that the laser scanner 24 will be able to read whether the correct signature is on the gathering chain 12.

In the foregoing description, it is implicit that a different bar code number will be assigned to each of the different signatures of the set that make up a book. Every packer box 14, 16, 18, etc., will also have a bar code scanner/decoder 24 to verify that the correct signature, i.e., the signature having the correct bar code for that packer box, has been fed onto the gathering chain 12 from that packer box. If the wrong signature has been fed, or a signature is fed when it was not supposed to be, or no signature has been fed, the book at that chain space will be rejected.

Referring to FIG. 1, an operating system has been schematically illustrated in order to thoroughly understand the present invention. It will be seen that there will typically be provided a plurality of photoelectric eyes 46, 48, 50, etc., each wired into one of the laser scanners 24 to serve as a trigger to tell the scanner when to attempt to read a bar code 22, i.e., the photoelectric eyes each detect when signatures from the upstream packer boxes cross the path of the eye. If a laser scanner 24 does not read a bar code 22 during a trigger period, the laser scanner 24 incorporates a decoder which logs a "NOREAD."

On the other hand, if a laser scanner 24 does read a bar code 22 during the trigger period, and the bar code 22 matched the bar code downloaded into the decoder for that packer box, the decoder logs a "MATCH."

As shown in FIG. 1, the laser scanners 24 may be wired into a conventional binding line control panel 52 which may, thus, receive a signal from any of the laser scanner/decoders 24 either where there is a "NOREAD" or a "NOMATCH". The latter condition will occur where a bar code is read, but it is not the bar code assigned to the corresponding one of the packer boxes and, in either case, the control panel 52 may then send a signal to a conventional divert station (not shown) downstream of the packer boxes 14, 16, 18, etc., to divert the book being formed, and the control panel 52 may also signal the binding line to reorder that particular book. As for the interfacing of the conventional binding line control panel 52 with the various operating components of the binding line 10, it will be understood by those skilled in the art that this will otherwise be conventional and well known.

From the foregoing, it will be appreciated that the present invention includes a unique and improved method for verifying that a signature has been fed from a packer box to a gathering chain. The method includes the step of providing common indicia in a preselected location on each of a plurality of signatures to be fed from the packer box to the gathering chain. It also includes the step of providing a scanner along the gathering chain generally adjacent the packer box to scan for the common indicia on the signatures in the preselected location. It further includes the step of scanning for the common indicia on the signatures in the region where the preselected location passes when one of the signatures has been fed to the gathering chain. The method still further includes the step of monitoring the scanner for recognition of the common indicia in order to verify whether a correct one of the signatures was successfully fed from the packer box to the gathering chain. With these unique features, the method may advantageously include the step of supporting the longer of a pair of folios of the signatures in a selected position during the scanning step.

Preferably, the longer of the pair of folios of the signatures is supported at an acute angle to a generally vertical plane which passes through the gathering chain. It is also highly advantageous for the method to include the step of diverting the longer of pairs of folios of signatures fed to the gathering chain by upstream packer boxes. More specifically, the longer folios of the signatures from upstream packer boxes are diverted to a generally vertical position parallel to a vertical plane passing through the gathering chain.

While in the foregoing there has been set forth a preferred embodiment of the invention, it will be appreciated that the details herein given may be varied by those skilled in the art without departing from the true spirit and scope of the appended claims.

What is claimed is:

1. In a binding line having a gathering chain movable past a plurality of packer boxes, said gathering chain having a plurality of chain spaces each of which is adapted to gather a signature from each of at least some of said packer boxes in seriatim fashion, said packer boxes each being adapted to hold a different one of a set of said signatures to be fed to said gathering chain, the improvement comprising:

common indicia in a preselected location on each of said signatures to be fed from at least one of said packer boxes; and scanning means along said gathering chain generally adjacent said one of said packer boxes holding said signatures having said common indicia, said scanning means being positioned relative to said gathering chain to scan for said common indicia in the region where said preselected location passes when one of said signatures has been fed to said gathering chain to occupy one of said chain spaces, and means associated with said scanning means for verifying if a correct one of said signatures occupies said one of said chain spaces.

2. The binding line of claim 1 wherein each of said signatures has a backbone, a head, a foot, and a pair of folios with one of said folios being slightly longer than the other of said folios.

3. The binding line of claim 2 wherein said preselected location on each of said signatures having said common indicia thereon is inside the longer one of said pair of folios thereof.

4. The binding line of claim 1 wherein said common indicia in said preselected location on each of said signatures is in the form of a bar code and said scanning means is a laser scanner.

5. The binding line of claim 4 wherein said laser scanner is supported on an adjustable scanner mounting bracket below said gathering chain and upstream of said packer box.

6. The binding line of claim 1 including a flare/divert unit mounted adjacent said gathering chain and said packer box for separating signatures to scan for said common indicia.

7. In a binding line having a gathering chain movable past a plurality of packer boxes, said gathering chain having a plurality of chain spaces each of which is adapted to gather a signature from each of at least some of said packer boxes in seriatim fashion, said packer boxes each being adapted to hold one of a set of said signatures to be fed to said gathering chain, the improvement comprising:

common indicia in a preselected location on each of said signatures to be fed from at least some of said packer boxes for identifying said signatures as being correct ones to be fed to said gathering chain from said packer boxes;

scanning means along said gathering chain generally adjacent each of said packer boxes holding said signatures having said common indicia, said scanning means each being positioned relative to said gathering chain to scan for said common indicia in the region where said preselected locations pass when one of said signatures has been fed to said gathering chain to occupy one of said chain spaces, and means associated with said scanning means for verifying if a correct one of said signatures occupies said one of said chain spaces; and a separate flare/divert unit mounted generally adjacent said gathering chain and each of said packer boxes for separating signatures in order to scan for said common indicia.

8. The binding line of claim 7 wherein each of said signatures has a backbone, a head, a foot, and a pair of folios with one of said folios being slightly longer than the other of said folios.

9. The binding line of claim 8 wherein said preselected location on each of said signatures having said common indicia thereon is inside the longer one of said pair of folios.

10. The binding line of claim 7 wherein said common indicia in said preselected location on each of said signatures is in the form of a bar code and said scanning means is a laser scanner.

11. The binding line of claim 10 wherein said laser scanners are each supported on an adjustable scanner mounting bracket below said gathering chain and slightly upstream of the corresponding one of said packer boxes.

12. The binding line of claim 7 wherein said flare/divert units each include a flare leg supporting the longer one of said folios of one of said signatures fed by the corresponding one of said packer boxes.

13. The binding line of claim 7 wherein said flare/divert units each include a divert leg diverting the longer ones of said folios of signatures fed to said gathering chain by upstream ones of said packer boxes.

14. In a binding line having a gathering chain movable past a plurality of packer boxes, said gathering chain having a plurality of chain spaces each of which is adapted to gather a signature from each of at least some of said packer boxes in seriatim fashion where each of said signatures has a backbone, a head, a foot, and a pair of folios with one of said folios being longer than the other, said packer boxes each being adapted to hold a different one of a set of said signatures to be fed to said gathering chain, the improvement comprising:

a different bar code in a preselected location on each of said signatures to be fed from at least some of said packer boxes for identifying said signatures as being correct ones to be fed to sa_id gathering chain from said packer boxes;

a laser scanner along said gathering chain generally adjacent each of said packer boxes holding said signatures having said bar codes, said laser scanners each being positioned relative to said gathering chain to scan for said bar codes in the region where said preselected locations pass when one of said signatures has been fed to said gathering chain to occupy one of said chain spaces, and means associated with said laser scanner for verifying if a correct one of said signatures occupies said one of said chain spaces; and a separate flare/divert unit mounted generally adjacent said gathering chain and each of said packer boxes for separating signatures in order to scan for said bar codes;

said flare/divert units each including a flare leg supporting the longer ones of said folios of said signatures fed to said gathering chain by the corresponding one of said packer boxes, said flare/divert units also each including a divert leg diverting the longer ones of said folios of signatures fed to said gathering chain by the upstream ones of said packer boxes.

15. The binding line of claim 14 wherein said preselected location on each of said signatures having said bar codes thereon is inside the longer one of said pair of folios.

16. The binding line of claim 15 wherein said bar codes are adjacent said heads of said signatures and along the edges of the longer ones of said pairs of folios remote from said backbones.

17. The binding line of claim 14 wherein said laser scanners are each supported on an adjustable scanner mounting bracket below said gathering chain and upstream of the corresponding one of said packer boxes.

18. The binding line of claim 17 wherein said flare legs each have upstream and downstream edges and a cutout adjacent said downstream edge exposing said bar codes to the corresponding one of said laser scanners.

19. The binding line of claim 18 wherein said adjustable scanner mounting brackets each include a laser scanner support arm mounted on a threaded rod for moving said laser scanner toward and away from said gathering chain.

20. The binding line of claim 18 wherein said adjustable scanner mounting brackets each are secured to said flare leg of the corresponding one of said flare/divert units in proximity to said downstream edge and cutout.

21. The binding line of claim 14 wherein said flare legs each have upstream and downstream edges and are disposed at an acute angle to a vertical plane through said gathering chain to support the longer ones of said folios.

22. The binding line of claim 14 wherein said divert legs each have upstream and downstream edges and an angled portion directing signatures fed by upstream ones of said packer boxes toward said gathering chain.

23. The binding line of claim 14 wherein said flare/divert units each have a generally inverted V-shape and include a wheel positioned above said gathering chain for holding said signatures down over said laser scanner.

24. A method for verifying that a signature has been fed from a packer box to a gathering chain, comprising the steps of:

providing common indicia in a preselected location on each of a plurality of signatures to be fed from said packer box to said gathering chain;

providing a scanner along said gathering chain generally adjacent said packer box to scan for said common indica on said signatures in said preselected location;

scanning for said common indicia on said signatures in the region where said preselected location passes when one of said signatures has been fed to said gathering chain; and monitoring said scanner for recognition of said common indicia in order to verify whether a correct one of said signatures was successfully fed from said packer box to said gathering chain.

25. The method of claim 24 wherein said preselected location for said common indicia on each of said signatures is inside the longer of a pair of folios thereof.

26. The method of claim 24 wherein said common indicia in said preselected location on each of said signatures is a bar code and said scanner is a laser scanner.

27. The method of claim 24 including the step of supporting the longer of a pair of folios of said signatures in a selected position during said scanning step.

28. The method of claim 27 wherein the longer of said pair of folios of said signatures is supported at an acute angle to a vertical plane through said gathering chain.

29. The method of claim 24 including the step of diverting the longer of pairs of folios of signatures fed to said gathering chain by upstream packer boxes.

30. The method of claim 29 wherein the longer of pairs of folios of said signatures are diverted to a generally vertical position parallel to a vertical plane through said gathering chain.

* * * * *